US005720824A

United States Patent [19]

Bronson et al.

[11] Patent Number: 5,720,824

[45] Date of Patent: Feb. 24, 1998

[54] PROPULSION CLEANING SYSTEM

[75] Inventors: David Bronson, Manhattan Beach; Don K. Fulkerson, Valencia; Richard E. Smith, Bakersfield, all of Calif.

[73] Assignee: Hughes Electronics, Los Angeles, Calif.

[21] Appl. No.: 692,024

[22] Filed: Aug. 1, 1996

[51] Int. Cl.[6] ..... C23G 1/08; C23G 1/10; C23G 1/12

[52] U.S. Cl. ..... 134/3; 134/28; 134/41; 252/188.28

[58] Field of Search ..... 134/3, 28, 41; 252/188.28

[56] References Cited

U.S. PATENT DOCUMENTS

| | | | |
|---|---|---|---|
| 3,622,391 | 11/1971 | Baldi | 134/3 |
| 4,015,950 | 4/1977 | Galland | 428/648 |
| 4,994,157 | 2/1991 | Itoh et al. | 204/145 |
| 5,051,140 | 9/1991 | Mushiake et al. | 148/203 |
| 5,131,126 | 7/1992 | Katsuki et al. | 29/81.06 |
| 5,292,374 | 3/1994 | Maresch et al. | 134/3 |

OTHER PUBLICATIONS

American Society for Testing & Materials ("ASTM"); Cleaning, Descaling, and Passivation of Stainless Steel Parts, Equipment, and Systems; Designation: A380–94a; Feb. 1, 1996; pp. 1–12.

ASTM; Standard Recommended Practice for "Descaling and Cleaning Titanium and Titanium Alloy Surfaces"; Designation: B–600–74; Reapproved 1985 pp. 469–471.

Federal Specification; "Passivation Treatments For Corrosion–Resistant Steel"; QQ–P–35C; Oct. 28, 1988; pp. 1–11.

Alfred C. Wright; USAF Propellant Handbooks, vol. II, "Nitric Acid/Nitrogen Tetroxide Oxiders"; vol. II; Feb. 1977, 3.40–3.41.

Baxter Scientific Products Specification Sheets for Nitric Acid; pp. 234–236.

Mallinckrodt Material Safety Data, Nitric Acid, 70%; Apr. 6, 1989; (3 pages).

*Primary Examiner*—Kriellion S. Morgan

*Attorney, Agent, or Firm*—Elizabeth E. Leitereg; Terje Gudmestad; Wanda K. Denson-Low

[57] ABSTRACT

A method is provided for removing metal oxide debris from various types of surfaces, both metallic and nonmetallic. Specifically, the surface to be cleaned is treated (preferably by immersion) with a preheated solution of 65 to 71 wt % (55.3 to 62.0 vol %) nitric acid, which is roughly equivalent to reagent grade nitric acid. The temperature of the solution is within the range of about 160° to 175° F. (71° to 79° C.). The preheated solution dissolves any metal oxide debris present on the surface, which may then be rinsed away following treatment. The method effects the removal of metal oxide residue from surfaces without further degrading the surfaces being cleaned. Further, the method is capable of cleaning internal surfaces of components without requiring disassembly of sealed or welded components, since all that is needed to effect cleaning is contact between the surface to be cleaned and the preheated solution. Finally, the method is easily implemented since it involves only the simple steps of contacting the component with a single preheated component that is widely available, namely reagent grade nitric acid, followed by rinsing and drying.

13 Claims, No Drawings

PROPULSION CLEANING SYSTEM

BACKGROUND OF THE INVENTION

1. Field of the Invention

The present invention relates generally to removing metal oxide debris from surfaces, and more particularly, to cleaning various types of surfaces, both metallic and nonmetallic, of such metal oxide debris as electron beam welding residue without further degrading the surfaces.

2. Description of Related Art

The welding of metals to assemble various components of aircraft and rocket structures has become standard practice. Significant weight savings are achieved by welding together such components, since welding eliminates the weight associated with riveted connections. There are two basic means of achieving a welded connection: fusion welding and solid-state welding. Fusion welding relies primarily on heat to join metals, while solid-state welding generally relies on plastic deformation to join metals.

Fusion welding involves placing two dean metal surfaces in intimate contact and focusing a source of heat upon the edges in contact, thereby fusing the metal components together into one homogeneous piece. There are various methods of fusion welding given that there are various ways to generate the necessary heat to fuse metals. For example, arc welding employs heat generated by an electric arc and gas welding employs high pressure oxygen and acetylene. A newer welding technique called electron beam welding harnesses a concentrated beam of high-velocity electrons to achieve the heat necessary to fuse metals. Electron beam welding is particularly advantageous in applications requiting precision welds such as the aircraft industry, since the highly concentrated electron beam makes possible weld beads with a high depth-to-width ratio, thereby decreasing the heat-affected zone and the amount of unnecessary deformation.

Regardless of the type of fusion welding employed, the process of welding typically results in the formation of weld debris comprising metal oxides on and about the surfaces in the vicinity of the weld. Electron beam welding in particular results in a weld metal "flash" residue. Such residue is highly undesirable in certain applications and must be removed. For example, foreign debris present in propulsion components of spacecraft can bring about the failure of such components. Therefore, it is important to remove metal oxide debris such as weld metal "flash" residue from components in sensitive applications. However, the method employed to remove such debris must not further degrade the surfaces being cleaned or other surfaces exposed to the treatment method, which for propulsion components may include various metallic surfaces and even nonmetallic surfaces such as polytetrafluoroethylene (PTFE).

It is known to employ acidic solutions to remove metal oxide debris from metallic surfaces. For example, it is known to employ hydrochloric acids or hydrofluoric acids in combination with other acids to deoxidize stainless steels. However, such acids often have an adverse effect on titanium alloys, which are common materials in the construction of propulsion components in spacecraft, among other applications. In the specification ASTM B600, entitled "Descaling and Cleaning Titanium and Titanium Alloy Surfaces", titanium surfaces are treated with a solution comprising 10 to 20 vol % nitric acid (70% grade) and 1 to 2 vol % hydrofluoric acid (60% grade), the solution having a temperature of about 120° F. (49° C.). It is important when practicing the ASTM B600 method that the ratio of nitric acid to hydrofluoric acid remain about 10:1 to minimize hydrogen absorption into the titanium during treatment. Further, the handling of hydrofluoric acid requires extra care given its hazardous nature. Thus, the method of ASTM B600 requires mixing two acids in a particular proportion, one of which requires special handling.

Another method of employing nitric acid solutions in the treatment of metal is described in Federal Specification QQ-P-35, entitled "Passivation Treatments for Corrosion-Resistant Steel". This method involves treating a 304L stainless steel surface with nitric acid to passivate the surface. Specifically, a stainless steel surface is immersed for a minimum of thirty minutes in a solution ranging from about 25 to 45 vol % nitric acid and having a temperature within the range of about 70° to 90° F. (21° to 32° C.), or alternatively, is immersed for a minimum of twenty minutes in a solution ranging from about 20 to 25 vol % nitric acid and having a temperature within the range of about 120° to 150° F. (49° to 66° C.). However, the method of QQ-P-35 only passivates descaled stainless steel; it does not remove or chemically dissolve weld "flash" product or stainless steel oxides in general.

Other methods of removing metal oxide debris from stainless steel are disclosed in ASTM A380, entitled "Cleaning, Descaling, and Passivation of Stainless Steel Parts, Equipment, and Systems". ASTM A380 specific that 200, 300, and 400 series stainless steel alloys may be treated with sic acid followed by a nitric acid and, optionally, a hydrofluoric acid treatment. ASTM A380 also discloses that 200, 300, and certain 400 series stainless steel alloys may be treated by immersion for five to thirty mutes in a solution consisting of about 15 to 25 vol % nitric acid and about 1 to 8 vol % hydrofluoric acid and having a temperature within the range of about 70° to 140° F. (21° to 60° C.). Finally, ASTM A380 specifies that free-machining alloys and certain 400 series stainless steel alloys may be treated by immersion for five to thirty minutes in a solution consisting of about 10 to 15 vol % nitric acid solution and having a temperature within the range of about 70° to 140° F. (21° to 60° C.). None of the methods disclosed by ASTM A380 effectively remove metal oxide debris such as weld flash residue from various metallic surfaces including titanium and nonmetallic surfaces such as PTFE without degrading the surfaces cleaned. Instead, each of the ASTM A380 methods either employ acids harmful to titanium and nonmetallic surfaces (such as hydrofluoric acid and sulfuric acid) or merely passivate the stainless steel surface as in the method of Federal Specification QQ-P-35. Further, ASTM A380, Section 5.2.1 specifically states that a solution consisting of both nitric acid and hydrofluoric acid is not recommended for descaling sensitized austenitic stainless steels or hardened martensitic stainless steels.

Thus, a need remains for a method to remove metal oxide debris, such as electron beam weld flash, from various metallic and nonmetallic surfaces without further degrading the surfaces cleaned. Further, the method should be capable of cleaning internal surfaces of components without requiring disassembly of sealed or welded components. Finally, the method should involve minimal handling and should be easily implemented in an industrial setting.

SUMMARY OF THE INVENTION

In accordance with the present invention, a method is provided for removing metal oxide debris from various types of surfaces, namely metallic surfaces and polymeric surfaces. The method comprises the steps of:

(a) providing a component comprising at least one material selected from the group consisting of at least one metal and at least one polymer, the component having a surface, the surface having metal oxides thereupon;

(b) contacting the surface with a preheated solution comprising about 65 to 71 wt % nitric acid, the preheated solution having a temperature within the range of about 160° to 175° F. (71° to 79° C.), the preheated solution serving to dissolve the metal oxides;

(c) removing the surface from contact with the preheated solution;

(d) rinsing the surface to remove any residual of the preheated solution along with any dissolved metal oxides therefrom; and (e) allowing the rinsed surface to dry.

The method of the present invention effects the removal of metal oxide residue, such as electron beam weld "flash", from metallic and polymeric surfaces without further degrading the surfaces being cleaned. Further, the method is capable of cleaning internal surfaces of components without requiring disassembly of sealed or welded components, since all that is needed to effect cleaning is contact between the surface to be cleaned and the preheated solution. Contact with an internal surface can be achieved by either immersing the entire component in the preheated solution or, preferably, merely flooding the interior of the component with solution. Finally, the method is easily implemented since it involves only the simple steps of contacting the component with a single preheated component that is widely available, namely reagent grade nitric acid, followed by rinsing and drying.

DESCRIPTION OF THE PREFERRED EMBODIMENTS

A method is provided for cleaning both metallic and nonmetallic surfaces to remove metal oxide debris therefrom without further degrading the surface. The method comprises the steps of: (a) providing a metallic and/or polymeric surface to be cleaned of metal oxides; (b) dissolving the metal oxides by contacting the surface with a preheated solution comprising about 65 to 71 wt % nitric acid, the solution having a temperature within the range of about 160° to 175° F. (71° to 79° C.); (c) removing the surface from contact with the preheated solution; (d) rinsing the surface to remove any residual of the preheated solution and dissolved metal oxides therefrom; and (e) drying the surface. Notably, the method of the present invention results in the removal of both surface metal oxides such as weld flash as well as metal oxides in and near the surface that were missed by prior descaling and/or passivation processes.

All concentrations herein are in weight percent, unless otherwise indicated. The purity of all components is that employed in normal commercial practice for acid-based cleaning solutions.

The materials benefited in the practice of the invention include any metals and combinations of metals, nonexclusive examples of which include stainless steels, titanium, and titanium alloys. In particular, stainless steel alloys benefited by the method of the invention include, but are not limited to, stainless steel alloys 302, 304, 304L, 316L, 321, 430, and 17-7 PH and 15-5 PH, with the latter two requiting limited exposure and/or specific heat treatment. Commercially pure titanium is benefited by the method of the invention, as are such titanium alloys as 6Al-4V titanium and 3.0Al-2.5V titanium. Bimetals such as an alloy of 304L stainless steel with either 6Al-4V titanium or 3.0Al-2.5V titanium are also benefited. Additionally, such polymers as polytetrafluoroethylene (PTFE) are also readily cleaned in the practice of the invention. It is contemplated that the method of the invention may be used to clean the internal surfaces of components such as propulsion components of satellite systems, with the propulsion components comprising such metals as stainless steels and titanium alloys as well as PTFE. However, the method of the invention may be used to clean metallic and polymeric surfaces of metal oxides in any application. While it is contemplated that the method of the invention is safe for use with all metals and polymers, it is suggested that the compatibility of materials besides stainless steels, titanium and its alloys, and PTFE with the preheated nitric acid solution be verified separately before such other materials are immersed in the solution.

Any metal oxides may be dissolved and removed using the present invention. Typically, a metal exposed to the atmosphere will develop a metal oxide layer about its surface, herein termed a "native metal oxide layer". Native oxides can be detrimental to a propellant component if they release iron which then contaminates the oxidizer. For example, steel (as opposed to stainless steel) releases free iron when exposed to nitrogen tetroxide, a common oxidizer propellant, forming an iron adduct which can contaminate the oxidizer. Additionally, in situ formation of solid or gel-like ferric nitrate derivatives can seriously obstruct propellant flow through valves, filters, or orifices. Passivation solutions such as described in Federal Specification QQ-P-35 remove the free iron and thin oxides but do not aggressively attack the thick oxides formed during elevated temperature exposures, such as during welding operations. In contrast, the method of the present invention results in the removal of both native metal oxides as well as the thick metal oxides formed during elevated temperature exposures.

While the method of the invention does remove at least a portion of the native metal oxide layer, it is specifically designed to rid surfaces of metal oxide debris that is either loose and only slightly adherent, thereby posing a risk of failure in a sensitive component such as a propulsion component of a satellite system upon breaking away from the substrate surface. Foreign debris exceeding only 61 microns in size can cause the failure of a propulsion component.

One source for loose or slightly adherent metal oxide debris is electron beam welding, which results in electron beam weld flash residue on the substrate surface. Electron beam welding is commonly used to assemble components in sensitive applications such as spacecraft components. Electron beam weld flash residue is typically in the form of needle-like particles loosely attached to the substrate surface. The present method dissolves such weld flash residue, along with any other surface metal oxides, thereby eliminating the threat of component failure deriving from loose metal oxide debris.

The key to the present method's success in removing metal oxide debris lies in the selection of the acid for the preheated solution as well as its concentration and temperature. A nitric acid solution is employed in the practice of the invention at a concentration ranging from about 65 to 71 wt %, which roughly conforms to reagent grade nitric acid that is commercially available such as through Baxter's Scientific Products catalog at 70.0 to 71.0 wt % nitric acid. The concentration range of about 65 to 71 wt % nitric acid solution equates to a concentration range of about 55.3 to 62.0 volume percent (vol %). Preferably, a reagent grade nitric acid solution having a concentration of about 70 to 71 wt % (60.8 to 62.0 vol %) nitric acid is employed in the practice of the invention, such that the nitric acid solution is preferably employed straight out of the proverbial bottle.

Employing a concentration of nitric acid less than about 65 wt % (55.3 vol %) does not adequately dissolve the metal oxide debris present at the substrate surface, while employing a concentration of nitric acid greater than about 71 wt % (62.0 vol %) is too difficult to handle, since the next higher grade of nitric acid is fuming nitric acid, which is typically 90 wt % (85.7 vol %) nitric acid. Further, employing a concentration of nitric acid greater than about 71 wt % (62.0 vol %) with certain stainless steels such as 430 alloys may corrode the metal surface by pitting.

In the practice of the invention, the nitric acid solution is preheated to a temperature within the range of about 160° to 175° F. (71° to 79° C.), by any suitable heating means, such as an oven or heat exchanger. Preferably, the nitric acid solution is preheated to a temperature within the range of about 165° to 170° F. (74° to 77° C.). At temperatures less than about 160° F. (71° C.), the nitric acid solution does not adequately dissolve the target metal oxide debris. On the other hand, at temperatures greater than 175° F. (79° C.), the nitric acid solution may volatilize and may be uncontrollable. Further, stainless steels are more aggressively attacked at temperatures greater than 175° F. (79° C.), which could result in corrosion of the surface by pitting.

The method of the invention involves placing the substrate surface to be cleaned in contact with the preheated nitric acid solution. Preferably, the surface remains in contact with the preheated solution for a total of at least about thirty minutes to ensure that any metal oxide debris on the surface is dissolved. Typically, a total contact time ranging from about thirty to forty-five minutes is required to dissolve electron beam weld flash debris, although the time duration may be adjusted to optimize the cleaning activity of the preheated nitric acid solution with the particular application. If the surface remains in contact with the preheated solution for too long, corrosion of the surface may result in the form of pitting. Notably, the contact may be conducted in stages. In the Example below, the surface is immersed for about 5 minutes then drained and re-immersed for about 25 minutes.

Preferably, the substrate surface to be cleaned is immersed in the preheated nitric acid solution to ensure complete and unimpeded contact between the nitric acid solution and any metal oxide debris. The method of the invention is advantageous in that a component, such as a typical propulsion component employed in a spacecraft, can be completely immersed in or flooded with the preheated nitric acid solution without degradation of the various combinations of materials used to assemble the component. In contrast, prior methods of deoxidizing stainless steel employing hydrofluoric and hydrochloric acids would likely damage titanium and its alloys as well as PTFE, such that the deoxidizing process necessarily required isolation of the target stainless steel substrates by disassembly of the propulsion component. By enabling the immersion or flooding of an entire component assembly so that internal passages are safely accessed by the solution, the method of the invention does not require the disassembly of a sealed or welded component to be cleaned.

After there has been sufficient contact between the substrate surface and the preheated nitric acid solution to dissolve the metal oxide debris, the substrate surface is removed from the preheated solution, rinsed, and dried. The rinsing step serves to remove any preheated solution as well as dissolved metal oxide debris remaining on the substrate surface. Preferably, the rinsing step is accomplished using deionized water, and more preferably, with deionized water aerated by nitrogen. The rinsing step may optionally be accompanied by agitation, such as by pulsing open and shut component valves during rinsing. Samples may be taken throughout the rinsing step to assess the particle size of any debris contained in the effluent. If samples indicate the presence of particles in excess of an acceptable size, the rinsing step could be repeated.

The drying step may be accomplished by allowing the substrate surface to air dry, or preferably, by placing the component in an oven preheated to a temperature of at least about 200° F. (93° C.). At the conclusion of the drying step, the substrate surface will have been cleaned of unwanted metal oxide debris.

The method of the invention results in the removal of metal oxide debris, such as electron beam weld "flash", from metallic and nonmetallic surfaces without causing further degradation thereto. Further, the method enables one to dean the internal surfaces of components without requiting disassembly of sealed or welded components. Finally, the method is easily implemented since it involves only the simple steps contacting the component with a single preheated component that is widely available, namely reagent grade nitric acid, followed by rinsing and drying. The Example below illustrates the contemplated use of the invention in cleaning the internal surfaces of a propulsion component.

EXAMPLE

The method of the invention was used to clean the internal surfaces of a thruster valve upon which electron beam welding had been conducted at several sites. Each of the materials present in the thruster valve were first identified and verified as compatible with exposure to the preheated nitric acid solution. The materials present in the thruster valve that were exposed to the nitric acid solution include the following: stainless steel alloys 302, 304, 304L, 316L, 321, 430, 17-7 PH; an alloy of 6Al-4V titanium and 304L stainless steel; and PTFE. Additionally, the thruster valve was tested for leaks before the cleaning treatment.

The thruster valve and the nitric acid solution were both separately placed in a Tenney oven, the nitric acid solution being contained in a stainless steel liquid supply cylinder. The nitric acid solution comprised about 70 to 71 wt % reagent grade nitric acid. Both the thruster valve and the nitric acid solution were preheated to a temperature of about 165° F. (74° C.). Once a temperature of about 165° F. (74° C.) was reached, a valve was opened allowing the preheated nitric acid solution from the liquid supply cylinder to flood the inside of the thruster valve. The thruster valve was drained after 5 minutes and refilled with preheated nitric acid solution. The thruster valve was then allowed to soak for about 25 minutes.

At the conclusion of the hot nitric acid solution soak, the nitric acid solution was drained from the thruster valve, and the thruster valve was pressurized to about 20 PSIG (1.36 atm) for 5 minutes of purging. Thereafter, the thruster valve was removed from the oven and flushed for about 15 minutes with deionized water aerated with nitrogen to a pressure of about 80 PSIG (5.44 atm) and a temperature of about 150° F. (66° C.), the valve seats being repeatedly pulsed open and closed during flushing. A gas purge was then done to purge residual water through the valve.

Samples were taken using a sample patch at the beginning, middle, and end of the aerated flush to check for particle size. The first sample patch contained particles resulting from filtration of the valve cavity volume of hot nitric acid diluted with 1000 mL of deionized water. The particles in this first patch were too numerous to count, with the patch covered with thousands of needle-like metallic particles. A second sample patch was taken after the aerated flush of about 2 hours in duration and 10 gallons (about 38 liters) of aerated water flushing. The particle size distribution was as follows:

| Particle Size Range, μm | Number of Particles |
|---|---|
| 11–20 | 33 |
| 21–30 | 11 |
| 31–40 | 4 |
| 41–50 | 3 |
| 51–60 | 2 |
| 60+ | 2 (2 particles over 100 μm) |

The third and final sample patch was taken after an additional 8 gallons (about 30 liters) of aerated water flushing. The particle size distribution was as follows:

| Particle Size Range, μm | Number of Particles |
|---|---|
| 11–20 | 18 |
| 21–30 | 6 |
| 31–40 | 4 |
| 41–50 | 2 |
| 51–60 | 1 |
| 60+ | 0 |

The gas-purged thruster valve was then placed in a thermal vacuum oven and vacuum dried at 240° F. (116° C.) for at least about 24 to 26 hours, with the valve seats being repeatedly pulsed during the first and final one-half hours. The cleaned thruster valve was then removed from the oven and allowed to cool to room temperature.

It is therefore demonstrated that the method of the invention is effective in removing metal oxide particles from the internal of the thruster valve assembly by sufficient immersion and rinsing, with the particle count being reduced dramatically from thousands of particles to a total of only 31 particles, none of which were greater than 60 μm in size.

INDUSTRIAL APPLICABILITY

The method of the invention is expected to find use in any industry having components assembled from various metals and polymers that must be free from metal oxide debris but that are assembled via welding, such as aircraft and spacecraft components.

Thus, there has been disclosed a method for cleaning metallic and non-metallic substrate surfaces of metal oxide debris without further degradation of the surfaces being cleaned. It will be readily apparent to those skilled in the art that various changes and modifications of an obvious nature may be made without departing from the spirit of the invention, and all such changes and modifications are considered to fall within the scope of the invention as defined by the appended claims.

What is claimed is:

1. A method for removing metal oxide debris from surfaces comprising the steps of:

(a) providing a component comprising at least one material selected from the group consisting of at least one metal and at least one polymer, said component having a surface, said surface having metal oxides thereupon;

(b) contacting said surface with a preheated solution comprising about 65 to 71 wt % nitric acid, said preheated solution having a temperature within the range of about 160° to 175° F. (71° to 79° C.), thereby dissolving said metal oxides;

(c) removing said surface from contact with said preheated solution;

(d) rinsing said surface to remove any residual of said preheated solution and said dissolved metal oxides therefrom; and (e) allowing said rinsed surface to dry.

2. The method of claim 1 wherein said at least one metal is selected from the group consisting of stainless steels, titanium, and titanium alloys.

3. The method of claim 1 wherein said at least one polymer comprises polytetrafluoroethylene.

4. The method of claim 1 wherein said preheated solution comprises about 70 to 71 wt % nitric acid.

5. The method of claim 1 wherein said preheated solution has a temperature within the range of about 165° to 170° F. (74° to 77° C.).

6. The method of claim 1 wherein said surface remains in contact with said preheated solution for at least about thirty minutes.

7. The method of claim 6 wherein said surface remains in contact with said preheated solution for a period of time ranging from about thirty minutes to forty-five mutes in duration.

8. The method of claim 1 wherein said surface is immersed in said preheated solution.

9. The method of claim 1 wherein rinsing said surface is accomplished using deionized water.

10. The method of claim 9 wherein rinsing said surface is accomplished by using deionized water aerated with nitrogen.

11. The method of claim 1 wherein drying said surface is accomplished by allowing said surface to air-dry at room temperature.

12. The method of claim 1 wherein drying said surface is accomplished by placing said component in an oven preheated to a temperature of at least about 240° F. (116° C.).

13. A method for removing metal oxide debris from surfaces comprising the steps of:

(a) providing a component comprising at least one material selected from the group consisting of a stainless steel, titanium, a titanium alloy, and polytetrafluoroethylene, said component having a surface, said surface having metal oxides thereupon;

(b) immersing said surface for a time period within the range of about thirty to forty-five minutes in a preheated solution comprising about 70 to 71 wt % nitric acid, said preheated solution having a temperature within the range of about 165° to 170° F. (74° to 77° C.), thereby dissolving said metal oxides;

(c) removing said surface from contact with said preheated solution;

(d) rinsing said surface with deionized water to remove any residual of said preheated solution and said dissolved metal oxides therefrom; and (e) allowing said rinsed surface to dry in an oven having a temperature of at least about 240° F. (116° C.).

* * * * *